US008181706B2

(12) United States Patent
Tanton

(10) Patent No.: US 8,181,706 B2
(45) Date of Patent: May 22, 2012

(54) PLUNGER LIFT

(75) Inventor: Michael Spencer Tanton, Calgary (CA)

(73) Assignee: IPS Optimization Inc., Calgary (CA)

( * ) Notice: Subject to any disclaimer, the term of this patent is extended or adjusted under 35 U.S.C. 154(b) by 69 days.

(21) Appl. No.: 12/785,324

(22) Filed: May 21, 2010

(65) Prior Publication Data

US 2010/0294507 A1 Nov. 25, 2010

Related U.S. Application Data

(60) Provisional application No. 61/180,721, filed on May 22, 2009.

(51) Int. Cl.
*E21B 43/12* (2006.01)

(52) U.S. Cl. ..... 166/372; 166/153; 417/56

(58) Field of Classification Search ..... 166/372, 166/68, 105, 153, 101, 106; 417/56, 57
See application file for complete search history.

(56) References Cited

U.S. PATENT DOCUMENTS

| | | | | | |
|---|---|---|---|---|---|
| 1,836,871 | A | * | 12/1931 | Ricker | 417/56 |
| 2,001,012 | A | | 5/1935 | Burgher | |
| 2,018,204 | A | * | 10/1935 | Evans et al. | 417/60 |
| 2,074,912 | A | | 3/1937 | Hutto | |
| 2,674,951 | A | | 4/1954 | Zaba | |
| 2,970,547 | A | | 2/1961 | McMurry | |
| 3,090,316 | A | | 5/1963 | Montgomery | |
| 3,181,470 | A | * | 5/1965 | Clingman | 417/56 |
| 3,302,581 | A | * | 2/1967 | Burch | 166/372 |
| 3,304,874 | A | | 2/1967 | Lyles | |
| 3,412,798 | A | | 11/1968 | Gregston | |
| 3,968,839 | A | | 7/1976 | Swihart, Sr. | |
| 4,070,134 | A | * | 1/1978 | Gramling | 417/56 |
| 4,190,112 | A | | 2/1980 | Davis | |
| 4,211,279 | A | | 7/1980 | Isaacks | |
| 4,502,843 | A | | 3/1985 | Martin | |
| 4,531,891 | A | | 7/1985 | Coles, III | |
| 4,625,795 | A | | 12/1986 | Despax et al. | |
| 4,629,004 | A | | 12/1986 | Griffin | |
| 4,889,473 | A | | 12/1989 | Krueger | |
| 4,923,372 | A | | 5/1990 | Ferguson et al. | |
| 5,335,727 | A | | 8/1994 | Cornette et al. | |
| 5,414,227 | A | | 5/1995 | Schubert et al. | |
| 5,427,504 | A | * | 6/1995 | Dinning et al. | 417/59 |
| 6,045,335 | A | | 4/2000 | Dinning | |

(Continued)

FOREIGN PATENT DOCUMENTS

| | | |
|---|---|---|
| CA | 2301791 | 11/2000 |

(Continued)

*Primary Examiner* — Daniel P Stephenson
(74) *Attorney, Agent, or Firm* — Bennett Jones LLP

(57) ABSTRACT

In a hydrocarbon producing wellbore, liquids (oil, condensate, water of mixtures thereof) from the formation may accumulate and build up a hydrostatic pressure gradient, which can kill gas production. Various embodiments of the present invention include a plunger lift system that can remove said formation liquids from a wellbore. A piston, including a sleeve with a hollow passage may travel downhole, accumulate formation liquids and utilizing the gas pressure deliver said formation liquids to the top of the wellbore for removal. The piston face may be one single wall that closes the hollow passage or the piston face may be comprised of a plug and an seat that unite to form a complete piston face downhole. Aspects of the plunger lift system, for example the sleeve and or the plug may be at least partially formed from materials that are buoyant in the formation liquids.

21 Claims, 3 Drawing Sheets

U.S. PATENT DOCUMENTS

| | | | | |
|---|---|---|---|---|
| 6,148,923 | A | 11/2000 | Casey | |
| 6,209,637 | B1 | 4/2001 | Wells | |
| 6,467,541 | B1 | 10/2002 | Wells | |
| 6,591,737 | B2 | 7/2003 | Giacomino | |
| 6,644,399 | B2 | 11/2003 | Abbott | |
| 6,669,449 | B2 | 12/2003 | Giacomino | |
| 6,719,060 | B1 | 4/2004 | Wells | |
| 6,725,916 | B2 * | 4/2004 | Gray et al. | 166/68.5 |
| 6,746,213 | B2 | 6/2004 | Giacomino | |
| 7,080,690 | B2 | 7/2006 | Reitz | |
| 7,093,652 | B2 | 8/2006 | Gray et al. | |
| 7,448,442 | B2 | 11/2008 | Wells | |
| 2006/0124292 | A1 * | 6/2006 | Victor | 166/68 |
| 2006/0144597 | A1 | 7/2006 | Casey | |
| 2006/0185853 | A1 * | 8/2006 | Bender | 166/372 |
| 2008/0185141 | A1 * | 8/2008 | Amies et al. | 166/105 |
| 2008/0283236 | A1 * | 11/2008 | Akers et al. | 166/105 |

FOREIGN PATENT DOCUMENTS

| | | |
|---|---|---|
| CA | 2521013 | 11/2000 |
| CA | 2353733 C | 2/2002 |
| CA | 2425573 C | 5/2004 |

* cited by examiner

PLUNGER LIFT

CROSS REFERENCE TO RELATED APPLICATIONS

The present application claims priority under 35 U.S.C. §119(e) to U.S. provisional patent application No. 61/180,721 filed May 22, 2009.

FIELD OF INVENTION

This invention relates to a plunger lift system for moving liquids upwardly in a hydrocarbon well.

BACKGROUND OF THE INVENTION

There are many different techniques for artificially lifting formation liquids from hydrocarbon wells. Reciprocating sucker rod pumps are the most commonly used in the oil field because they are the most cost effective, all things considered, over a wide variety of applications. Other types of artificial lift may include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular.

Gas wells reach their economic limit for a variety of reasons. A very common reason is the gas production declines to a point where the formation liquids are not readily moved up the production string to the surface. Two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical value, or stops, the liquid runs down the inside of the well and accumulates in the bottom of the well.

If sufficient liquid accumulates in the bottom of the well, the well is no longer able to flow because the pressure in the reservoir is not able to flow against the pressure of the liquid column.

The well is said to have loaded up and died. It can be economical to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle.

Free pistons or plunger lifts are used as an artificial pumping system to raise liquid from a well that produces a substantial quantity of gas. Conventional plunger lift systems comprise a piston that is dropped into the well. The piston is often called a free piston because it is not attached to a sucker rod string or other mechanism to pull the piston to the surface. When the piston drops into the bottom of the well, it falls into the liquid in the bottom of the well and sinks down ultimately into contact with a bumper spring, normally seated in a collar or resting on a collar stop. Gas flowing into the well pushes the piston and liquid on top of the piston upwardly to the surface.

Canadian Patents 2,301,791 and 2,521,013 disclose plunger lift systems and technologies. Improvements on these systems of plunger lifts may be of interest.

SUMMARY

In accordance with a broad aspect of the present invention there is provided a plunger lift system for lifting formation liquids from a well producing through a wellbore communicating with a hydrocarbon formation, comprising: a free piston with a sleeve including an open end, an opposite end, a hollow passage therebetween to accumulate the formation liquids and a piston face on the opposite end; the free piston having an external diameter that is substantially similar to the inner diameter of the wellbore; the piston being moveable between a top of the wellbore and a lower portion of the wellbore; and, the piston including at least a portion thereof formed of a material that is buoyant relative to the formation liquids.

In accordance with another broad aspect of the present invention there is provided a method of lifting formation liquids from a wellbore using a plunger lift system comprising: a free piston with a sleeve including an open end, an opposite end, a hollow passage therebetween to accumulate formation liquids and a piston face on the opposite end; the free piston having an external diameter that is substantially similar to the inner diameter of the wellbore; the free piston being moveable between a top of the wellbore and a lower portion of the wellbore; the free piston including at least a portion thereof formed of a material that is buoyant relative to any formation liquids in the lower portion of the wellbore and an upper bumper; releasing the free piston into the wellbore so that it falls to the lower portion of the wellbore; accumulating formation liquids; and allowing a residence time to pass so that a formation gas pressure flow pushes the piston to the top of the wellbore.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several embodiments of the present invention are illustrated by way of example, and not by way of limitation, in detail in the figures, wherein.

DETAILED DESCRIPTION OF VARIOUS EMBODIMENTS

Figure 1:
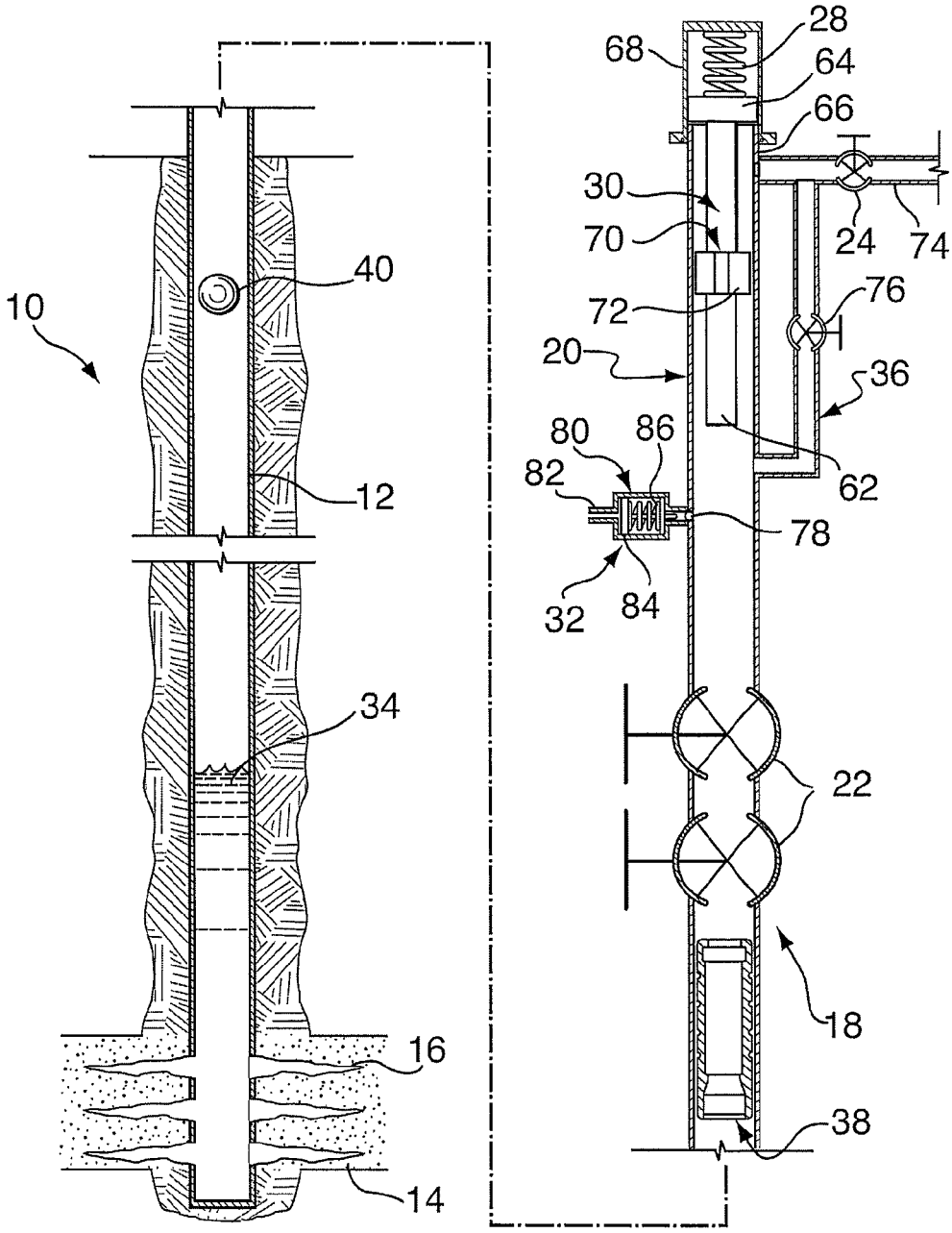
FIG. 1 is a schematic view of a well equipped with a plunger lift system of one embodiment of the present invention.
Figure 3:
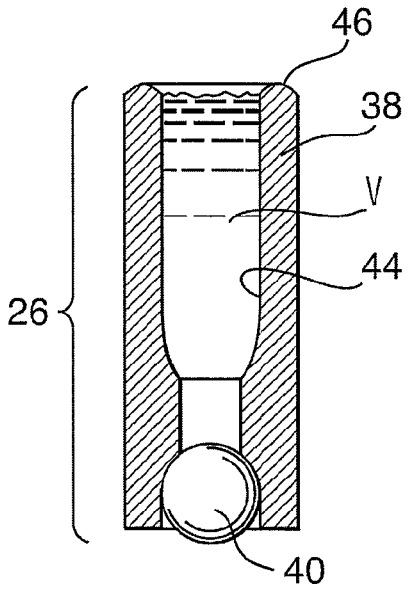
FIG. 3 is a sectional view through a united piston.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

For the purposes of this disclosure, the term "uphole" will refer to a direction towards the wellhead at surface and the term "downhole" will refer to a direction away from the wellhead at surface, along the path of the wellbore, regardless of whether the wellbore deviates from a substantially vertical alignment, for example in a directionally drilled wellbore with a substantially horizontal wellbore section.

A wellbore may contain a column of formation liquid at the lower portion of the well. Formation liquid can be, for example, oil, condensate, water or a mixture thereof and it may be desirable to remove said formation liquid to prevent the well from loading up and dying. The present invention provides various embodiments that may provide a solution for the removal of said formation liquid.

A plunger lift may provide a means of removing formation liquids from the lower portion of the wellbore. A plunger lift may include a piston that can be introduced into a column of formation liquid at the bottom of a well. As will be further explained, the plunger lift piston may include at least a portion formed of buoyant materials that causes it to move to a substantially floating position in the formation liquid. The buoyancy properties may cushion any impact of the plunger lift as it reaches the bottom of the well and prevent it from sinking fully in the liquid in the well. This may avoid the need for a bottom bumper spring.

The plunger lift system may include a piston and the piston may include a sleeve with a hollow central passage, and a piston face that extends substantially across the outer diameter of the piston, for example across the bottom of the piston. Further, the piston may have a cross-sectional area comparable to and substantially the same as to the inner diameter of the well in which it is used. As such, any gas entering the production string from the formation under the piston is blocked from passing around the piston and the gas may push the piston upwardly, thereby lifting the piston, and any liquid retained by the piston upwardly in the well to the surface. Liquid retained by the piston will be that amount above the piston when the fluid pressure from below begins to move the piston upwardly, and generally will be that amount trapped in the sleeve above the plug. As the piston moves upwardly in the well, certain amounts of liquid may be picked up and accumulated from the wellbore walls and pushed ahead of the piston.

The piston face may be a singular component, such as an extension of the sleeve wall across the bottom of the central passage or the piston face may be comprised of an independent or tethered plug that unites with the sleeve to form a piston face across the bottom of central passage.

For example, one embodiment of the present invention may provide a plunger lift for a well producing through a well bore communicating with a hydrocarbon formation, comprising a free piston having an upper sleeve with a passage therethrough and a sleeve plug. The upper sleeve and the plug are moveable between a united position wherein the plug sits in the passage of the sleeve and an open position where the plug is spaced from a seated position in the passage. As such, when seated, the plug can control flow of fluids through the passage, but can be removed to allow flow of fluids through the passage. The sleeve and plug are movable through the well. The sleeve and plug may be united at the bottom of the well and have an exterior seal for upward movement together in the well for lifting liquid upwardly in the well. The sleeve providing a seating surface for receiving the plug and the plug is freely movable into and out of a seating position relative to the sleeve. The plug may be buoyant in water such that it floats to some degree on any column of liquid in the well.

In one embodiment, the central passage of the sleeve may provide a passageway through which the gas flows as the sleeve falls in the well and the plug may be sized to close the central passage and provide a second piece of the piston face. A flow passage is found around the plug as it falls in the well. A ball appears to be an ideal shape for the plug of a two part piston of a plunger lift because repeated impacts are not concentrated in any one location so wear is spread around and the ball being substantially uniform in exterior curvature can, regardless of its particular orientation, create a seal with the sleeve.

When the united components reach the well head at the surface, a decoupler separates the sleeve from the plug in much the same manner as that disclosed in Canadian patent no. 2,301,791. As soon as the united piston is opened by the decoupler, the plug accordingly immediately has a tendency to fall toward the bottom of the well. Conveniently, a catcher holds the sleeve and then releases the sleeve after the plug is already on the way to the bottom or after a delay period that is used to control the cycle rate of the plunger lift.

Plunger lift pistons made of metal such as steel, titanium, aluminum, etc. have proved quite successful in most wells. However, the previous plunger lift requires a bottom bumper to be installed to limit the degree to which the piston can fall in the well. As such, since the location of the bottom bumper is fixed in the well, the depth of liquid column above the bumper will vary. Depending on the amount of liquid in the well, it is sometimes difficult to lift large columns of liquid.

This invention may provide a substantially buoyant plug to cause the plug's movement down the well to be stopped when it comes in contact with the liquid column in the bottom of the well. After the sleeve falls onto the plug downhole, the parts unite. Before the parts unite downhole or due to the tendency for the parts to initially become submerged from impact or splash, the sleeve will fill with an amount of liquid before the plug seats in the bore of the sleeve. Thereafter, as the produced fluids lift the piston at least the amount of liquid in the sleeve will be carried to surface and unloaded from the well.

Figure 2:
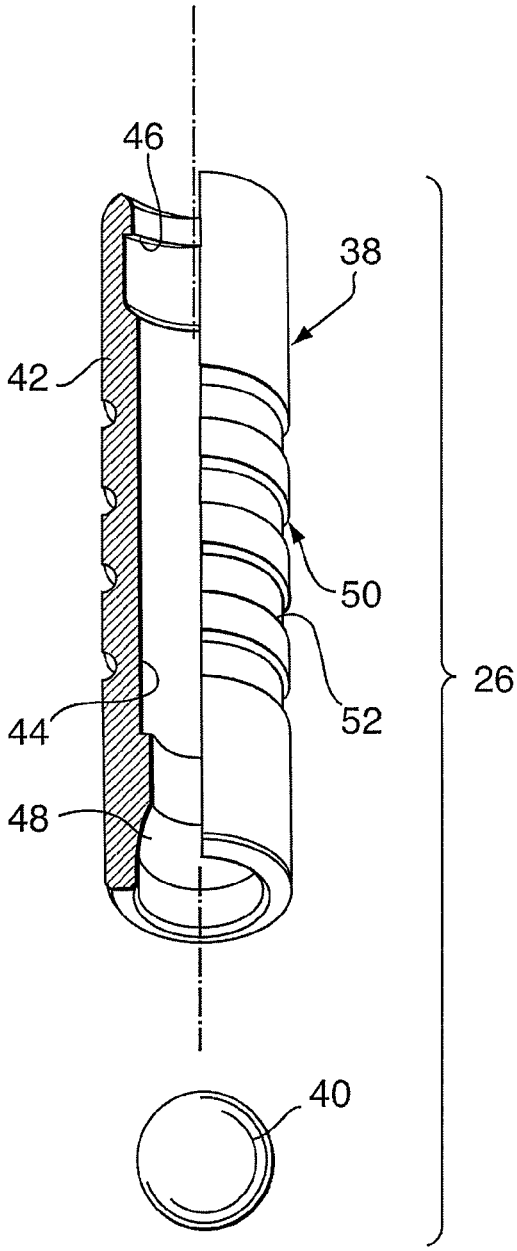
FIG. 2 is an exploded isometric view of an embodiment of the present invention, partly in section, showing the sleeve and ball plug.

Referring now to FIGS. 1 and 2, a hydrocarbon well 10 comprises a wall 12 extending into the earth may be in communication with a subterranean hydrocarbon bearing formation 14. The wall 12 is typically defined by the inner diameter of a conventional tubing string made up of joints of tubing that are threaded together. The wall 12 may be the inside of a casing string, a tubing string, a production string, etc. The formation 14 communicates with the inside of the well through perforations 16. As will be more fully apparent hereinafter, the plunger lift system may be used to lift formation liquid 34 from the bottom of the well 10 which may be either an oil or a gas well.

In one embodiment of the present invention, the well 10 is a gas well that produces some formation liquid 34 that may be contained in a column at the lower portion of the wellbore and further found along the walls of the wellbore. In an earlier stage of the productive life of the well 10, there is sufficient gas being produced to deliver the formation liquids to the surface. The well 10 is equipped with a conventional well head assembly 20, for example, comprising a pair of master valves 22 and a wing valve 24 delivering produced formation products to a surface facility for separating, measuring and treating the produced products.

One embodiment of the present plunger lift invention may comprise, as major components, a piston 26 (FIG. 2), including in this embodiment a ball plug 40 and a sleeve 38, an upper bumper 28, a decoupler 30, a catcher assembly 32, and a bypass 36 around the piston 26 when it is its uppermost position in the well head assembly 20 (FIG. 1).

As noted, in one embodiment the piston 26 may be of multi-part construction including an upper sleeve 38 and a plug, for example a ball 40. The sleeve 38 comprises a tubular body 42 having a central passage 44, a fishing lip 46 at the upper end thereof and an annular seating surface 48 at the lower end thereof sized to closely receive the ball 40. In other words, the seating surface 48 may generally define a concave surface, for example a portion of a concave spherical surface and has a radius of curvature substantially matching that of the plug 40. The seating surface 48 may be recessed or nested into the sleeve 38 so that the ball 40 fits up into the sleeve 38, when in the seated position. The main reason is that when the sleeve 38 contacts the plug 40 at the bottom of the well, the ball 40 is overlapped and retained by the sleeve.

The exterior of the sleeve 38 provides a seal arrangement 50 to minimize fluid on the outside of the sleeve 38 from bypassing around the exterior of the sleeve 38. The seal arrangement 50 may be of any suitable type, such as elastomeric ring, wire wound around the sleeve, a multiplicity of bristles or the like or may, as shown, comprise a series of simple grooves or indentations 52. The grooves 52 work because they create a turbulent zone between the sleeve 38 and the wall 12 thereby restricting fluid flow on the outside of the sleeve 38. The grooves 52 may also be used as a catch area for a retriever to hold the sleeve 38 at a well head, as will be more fully apparent hereinafter.

Figure 4:
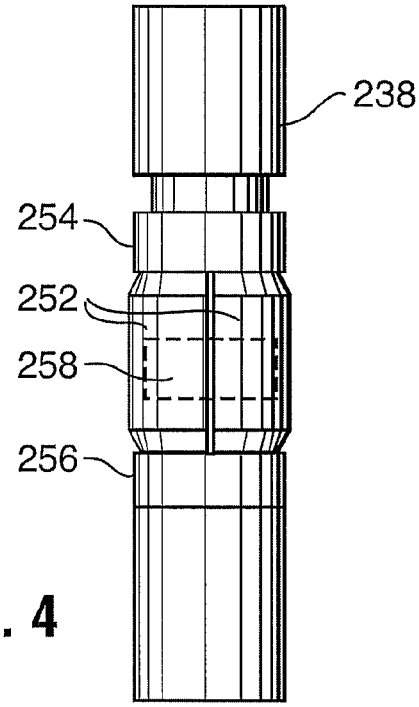
FIG. 4 is a side elevation view of another embodiment of the present invention.

As another example, a plurality of pads 252 encircling a sleeve 238 may be employed (FIG. 4). The pads 252 may be retained by upper 254 and lower 256 retaining rings. The retainer rings may enable pads 252 to float between the rings and the outer surface of the sleeve body. The pads 252 may be biased away from the sleeve body. In another example, there may be an elastomeric, for example rubber, seal 258 that encircles the body of sleeve 238 beneath pads 252. Seal 258 may assist in biasing pads 252 radially outwardly and prevent any wellbore fluids from being trapped between sleeve 238 and pads 252.

The ball 40 may act as a plug to seal passage 44 through the sleeve, when the ball and the sleeve are in a united position. The ball may have a radius of curvature substantially matching the seating surface 48. By suitably machining the ball 40 and surface 48, no resilient seals or additional seals of any type may be necessary. The seating surface 48 may be machined to a clean finish or no special surface preparation may be performed. After a few impacts with the ball 40, the seating surface 48 may assume a desirable surface finish.

The plug may be fully separable from the sleeve or alternatively, the plug may be loosely attached to the sleeve. For example, the plug may be a ball or a dart that is fully separable from the sleeve to move independently therefrom. In another embodiment, the plug may be tethered to the sleeve. For example, the plug may be a connected part such as a spear that includes a plug end and a retainer that holds the plug loosely adjacent the sleeve passage, such that it can move into or out of a united position in the passage but cannot fully separate from the sleeve.

As will be more fully apparent hereinafter, the ball 40 may be released, for example launched or dropped into the well 10 so that the ball travels to the column of formation liquids in the lower portion of the wellbore. Following which, the sleeve 38 may be released. The ball 40 and sleeve 38 accordingly may fall independently into the well 10, usually while the well 10 is producing gas and liquid which flows upwardly through the well head assembly 20. By independently, it is meant that the ball 40 is not seated in the sleeve 38 and the ball 48 and the sleeve 38 are capable of moving to some degree independently of one another even if they are tethered or connected together in some fashion. When the ball 40 and sleeve 38 reach the bottom of the well, they nest together with ball 40 united in seat 48 in preparation for moving upwardly. In particular, the ball may be stopped first and the sleeve lands above and possibly on the ball and the ball moves into a united position in area 48 to complete the piston and form a piston face.

In one embodiment, the sleeve 38 and ball 40 each may have a flow bypass so they separately fall easily into the well 10 even when there is substantial upward flow in the production string 12. When they reach the bottom of the well, they may align into the united position of a single component which substantially closes the flow bypasses, or at least restricts them, so gas entering through the perforations 16 may push the piston 26 upwardly in the well and thereby carry any liquid, at least in the sleeve, upwardly toward the well head assembly 20, Looked at in another perspective, the sleeve 38 and ball 40 each have a surface area which is selected so that they independently fall in the well but, when they are united into the piston, they form a piston face such that the piston is pushed upwardly in the well thereby carrying any liquid retained within the central passage sleeve upwardly toward the well head assembly 20. The selection of the surface areas of the sleeve 38 and ball 40 may be done so that a given pressure differential will move the ball 40 before moving the sleeve 38. In other words, the ball 40 may be easier to move than the sleeve 38. The reason is that if the ball 40 can be constructed so it always pushes from below, there is no tendency for the sleeve 38 to separate from the ball 40 during upward movement in the well 10.

The upper bumper 28 and decoupler 30 may be of any conventional designs and are well known in the plunger lift art and are commercially available.

The upper bumper 28 acts to stop upward progress of the piston in the wellhead and the decoupler 30 acts to separate the piston when it reaches the well head assembly 20. The decoupler 30 in one embodiment comprises a rod 62 sized to pass into the top of the sleeve 38 and is fixed to a piston 64. The piston 64 is larger than a conduit 66 in which the rod 62 reciprocates and is, thus, prevented from falling into the well 10. The top of the well head assembly 20 is closed with a screw cap 68. A stop 70 on the rod 62 limits upward movement of the sleeve 38. A series of grooves 72 allow formation products to pass around the stop 70 and into a flow line 74 connected to the wing valve 24. It will be seen that the piston moves upwardly in the well 10 as one piece. When the sleeve 38 passes onto the end of the rod 62, the rod ultimately contacts the top of the ball 40, stopping upward movement of the ball 40 and allowing continued upward movement of the sleeve 38. The end of the rod 62 below the stop 70 is longer than the passage 44 so the ball 40 is pushed out of the sleeve 38 thereby releasing the ball 40 which falls toward the bottom of the well 10.

The bypass 36 may help prevent the piston 26 from sticking in the well head assembly 20 and may include a valve 76. The bypass 36 opens into the well head assembly 20 below the bottom of the sleeve 38 when it is in its uppermost position in the well head assembly 20. Thus, there will be a tendency of gas flowing through the well head assembly 20 to move through the bypass 36 rather than pinning the sleeve 38 against the stop 70.

A catcher 32 may be provided to latch onto the sleeve 38 and thereby hold it for a while to provide a delay period or lag between successive cycles of the piston in an attempt to match the cycle rate of the piston with the well 10 to remove produced formation liquid as expeditiously as possible and thereby restrict gas production as little as possible. To these ends, in the present illustration, grooves 52 of the sleeve 38 are sized to receive a ball detent 78 forced inwardly into the path of the sleeve 38 by an air cylinder 80 connected to a supply of compressed gas (not shown) through a fitting 82. A piston 84 in the cylinder 80 is biased by a spring 86 to a position releasing the ball detent 78 for movement out of engagement with one of the slots 52. Pressure is normally applied to the cylinder 80 thereby forcing the ball detent 78 into the path of travel of the sleeve 38. Upon a signal from a controller (not shown), gas pressure is bled from the cylinder 80 allowing the spring 86 to retract the piston 84 and allowing the weight of the sleeve 38 to push the ball detent 78 out of the slot 52 thereby releasing the sleeve 38 for movement downwardly into the well 10.

When it is desired to retrieve the ball 40 or the sleeve 38, the decoupler 30 is replaced with a similar device having a stop 70 but eliminating the rod 62. This causes the sleeve to impact the bumper 28 without dislodging the ball 40. The piston is held in its upward position by the flow of formation products around the piston in conjunction with the catcher 32 which latches onto the sleeve 38.

Operation of the plunger lift of one embodiment of the present invention should now be apparent. The ball 40 is first dropped into the well 10. When the ball nears the bottom of the well, it may fall into formation liquid near the bottom of the well but due to being formed, at least partially, of a buoyant material the ball may occupy a substantially floating position, for example floating completely upon the formation liquids or floating partially or completely submerged within the formation liquid. This may cushion any impact of the ball as it reaches the bottom of the well and prevent the ball from sinking fully in the liquid in the well. When the sleeve 38 is released by the catcher 32, the sleeve will fall and reach the ball, they will align into a united position, for example into a single piston face that has a cross-sectional area comparable to the inner diameter of the well in which it is used, i.e. any gas entering the production string from the formation under the piston is blocked from passing around the piston and pushes it upwardly, thereby lifting the piston and any liquid accumulated by the piston upwardly in the well to the surface. Liquid retained by the piston will be that amount above the plug when the fluid pressure from below begins to move the united piston upwardly, and generally will be that amount trapped in the sleeve above the plug. As the piston moves upwardly in the well, certain amounts of liquid may also be accumulated from the wellbore walls and may be pushed ahead of the piston. Because ball 40 easily enters the bottom opening of the sleeve 38, the ball 40 and sleeve 38 easily unite with the ball 40 sealing against the seating member 48. The combined downwardly facing surface area of the sleeve 38 and ball 40, in their united configuration, is sufficient to allow gaseous products from the formation 14 to push the united parts 38, 40 forming the piston, and any liquid above the ball, upwardly to the well head assembly 20.

As the piston approaches the well head assembly 20. The sleeve 38 passes over the rod 62 which stops upward movement of the ball 40 thereby releasing the ball 40 which drops into the well 10 in the start of another cycle. The sleeve 38 is retained by the catcher 32 at least momentarily longer and maybe for a period of time depending on the requirements of the well 10. If the well 10 needs to be cycled as often as possible, the delay provided by the catcher 30 is only long enough to be sure the ball 40 is unseated from the sleeve 38. In more normal situations, the sleeve 38 will be retained on the catcher 30 so the piston 26 cycles only when desired.

While previous pistons formed of metal have proved quite successful in a wide variety of applications, wells having very low bottom hole flowing pressures, e.g. 75 psi, present an unusually tough situation for any type of plunger lift for a variety of reasons, almost all of which relate to the fact that very little liquid will kill the well.

For purposes of illustration, assume that a well has a 75 psi bottom hole flowing pressure and fifty feet of liquid in the bottom of the hole above the perforations when the plunger piston arrives. A prior art plunger lift might be unable to address such a well condition. In particular, when a prior art piston arrives at the bottom of the hole, it will sink until it is stopped, for example by a bottom bumper, which is generally positioned below the perforations. When the piston starts up the hole, in response to bottom hole flowing pressure under the piston, it will attempt to lift the entire fifty foot column of liquid plus any liquid that has been sheared off during downward movement of the sleeve plus any liquid that is picked up during upward movement of the piston. Because the bottom hole flowing pressure is so low, it is easy to collect enough liquid above the piston, to slow down and stop the piston or to prevent it ever from starting up the well. When this occurs, the piston ultimately falls to or remains at the bottom and the well is dead.

It has been found that by forming the ball 40 and possibly also the sleeve 38 of a material capable of floating to some degree in formation liquids, for example oil, condensate, water or a mixture thereof, the volume of fluid attempted to be carried by the piston to surface can be controlled to prevent the weight of the fluid column above the piston from overcoming and stopping movement of the piston. If the sleeve is multi part, and it is intended have some buoyancy, as shown in FIG. 4, some or all sleeve components can be made of buoyant materials. For example in FIG. 4, both the tubular body of the sleeve and the pads may be formed of buoyant materials.

In one embodiment, for example, the ball 40 may be formed of a buoyant material such that the ball is buoyant to some degree in wellbore fluids. For example, the buoyant material may have a specific gravity of about 1 or less, where the specific gravity of water is 1. The specific gravity of hydrocarbons (such as condensate or oil) is lower than water and this may have to be considered if the formation liquids are high in hydrocarbons. Therefore, depending upon the constituents of the formation liquids, the buoyant material may have a specific gravity of less than 1:1 with the formation liquids within the well. Examples of buoyant materials may include wood, substantially buoyant polymers for example phenolics such as polyphenols and high density polyethylene, foamed materials, hollow materials, etc. Of course durability of the material in well bore conditions and impact resistance must also be considered. However, since the ball and sleeve cycle to surface regularly their condition can be monitored occasionally and replacement or repair can be carried out if necessary.

In another embodiment, where it is useful to detect the position of the piston, for example magnetically, it may be beneficial to include a metal portion on the body of the piston. For example, the piston may be made of buoyant materials and the retainer bands, as shown in FIG. 4, may be made of metal, provided overall the piston is capable of substantially floating in formation liquids.

Sleeve 38 may formed to sit on the ball and, so, can be selected to be retained in a substantially floating condition by the ball or can itself be formed of a buoyant material similar to, or different from, the ball. For example, in one embodiment the ball can be at least partially formed from materials that are more buoyant in the formation liquids than the materials of the sleeve. In this embodiment, the greater buoyancy of the ball, relative to the sleeve, may assist in creating a tighter seal at the seating surface when the ball and the sleeve unite.

The buoyancy of at least the ball acts to limit the degree to which the ball can sink in the fluid column and limit the volume of water to be carried by the piston. In particular, the ball after hitting the liquid will be urged by its buoyancy into a substantially floating position in the formation liquid column. The sleeve when it lands will momentarily receive liquid into passage 44, but will quickly settle into position united with ball 40, wherein ball 40 is seated in sleeve 38. A volume of liquid V can move into passage 44 through upper end 42, as when the sleeve drops below surface or by splash, or through the sleeve's lower end before the ball is seated in the passage. When ball 40 seals against seat 48 and formation pressures begin to act from below the ball, any liquid accumulated in passage 44 is trapped therein.

The volume of liquid carried to surface may be defined by the volume defined in passage 44 between upper end 46 and ball 40 and the depth at which the piston floats below surface, if at all, before beginning uphole. However, while travelling uphole, the piston may accumulate more fluids from the wellbore walls. The piston can cycle rapidly to unload the well and can allow unloading even in low production and large diameter wells where production flow may limit the usefulness of prior art plunger lifts.

In addition to the controlled and more readily liftable volume of liquid handled by the piston, the buoyancy acts as a shock absorber and bottom stop for the piston. Also, there is no need to install a bottom bumper in the well.

Also, surface facilities needn't be equipped to handle large plugs of formation liquid.

Figure 5:
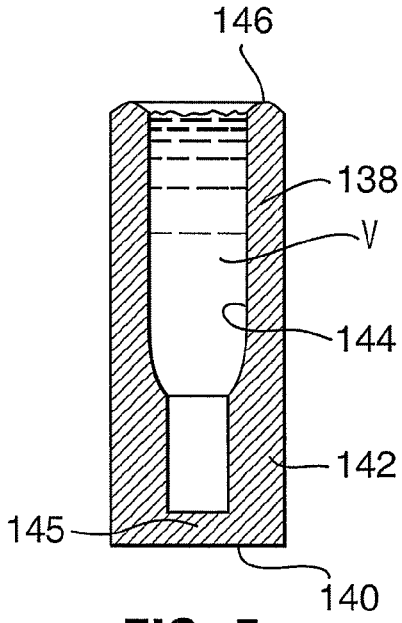
FIG. 5 is a sectional view through one embodiment of the present invention.
Figure 6:
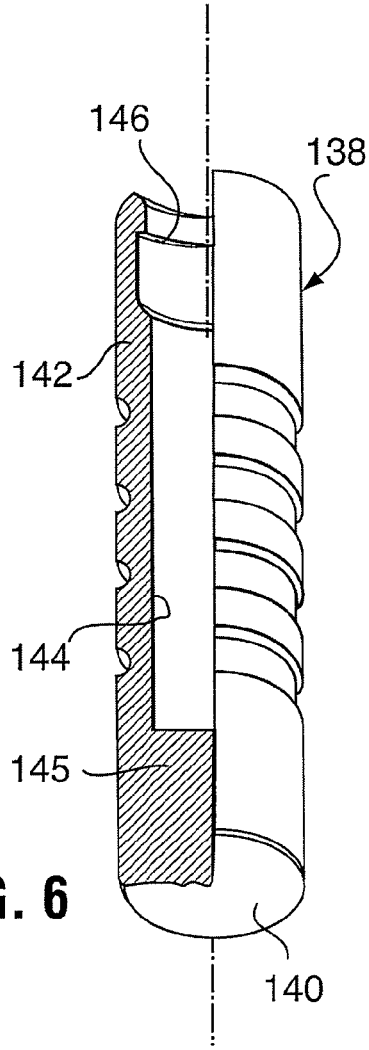
FIG. 6 is an exploded isometric view of an embodiment of the present invention, partly in section.

In another embodiment, a piston 126 may be of one piece construction, wherein the sleeve 138 has a closed bottom that forms a piston face 140 (see FIGS. 5 and 6). In particular, sleeve 138 comprises a tubular body 142 having a central passage 144 extending from an open upper end 146 and closed at its bottom end by an end wall 145 to form the piston face 140. Because the piston face is integral with the sleeve, as one single piece, there may not be a necessity for a decoupler and a catcher, as herein described above. It may be that piston 126 does not have any flow bypasses and it may be necessary to attenuate or stop the uphole flow of fluids, such as formation gas in order to allow the piston to move downhole. The wellhead assembly may be actuated, using techniques familiar to those skilled in the art, to temporarily shut-in the well so that the piston 126 may fall downhole.

Piston 126 may be formed, in whole or in part, from buoyant materials as described herein above. Further, piston 126 may have a fish lip 146 substantially towards open upper end.

When piston 126 reaches the formation liquids it may occupy a substantially floating position, as described herein above, within the column of formation liquids, accumulating formation liquids within the central passage 144 in a fashion similar to the accumulation of formation liquids in passage 44 as described herein above.

When desired, the operator may actuate the wellhead assembly to open the well so that formation gas pressure may be free to push piston 126, and the formation liquids accumulated therein, uphole. Further, piston 126 may accumulate liquids from the wellbore walls while travelling uphole. An upper bumper of any conventional designs and are well known in the plunger lift art may be employed.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed:

1. A plunger lift system for lifting formation liquids from a well producing through a wellbore communicating with a hydrocarbon formation, comprising:

(a) a free piston with a sleeve including an open end, an opposite end, a hollow passage therebetween to accumulate the formation liquids and a piston face on the opposite end, the piston face being an end wall that extends across the entirety of the opposite end to close the hollow passage;

(b) the free piston having an external diameter that is substantially similar to the inner diameter of the wellbore;

(c) the free piston being moveable between a top of the wellbore and a lower portion of the wellbore; and (d) the free piston including at least a portion thereof formed of a material that is buoyant relative to the formation liquids.

2. The plunger lift system of claim 1, further comprising a metal component carried on the free piston.

3. The plunger lift system of claim 1, further comprising an upper bumper to engage and stop the piston's upward progress.

4. A method of lifting formation liquids from a wellbore using a plunger lift system comprising:

(a) releasing a free piston into the wellbore so that it falls to the lower portion of the wellbore, (b) the free piston including a sleeve with an open end, an opposite end, a hollow passage therebetween to accumulate formation liquids and a piston face on the opposite end wherein the piston face is a singular piece that is integral with the sleeve; the free piston having an external diameter that is substantially similar to the inner diameter of the wellbore; the free piston being moveable between a top of the wellbore and a lower portion of the wellbore; the free piston including at least a portion thereof formed of a material that is buoyant relative to any formation liquids in the lower portion of the wellbore, (c) accumulating formation liquids above the free piston; and (d) allowing a residence time to pass so that a formation gas pressure flow pushes the free piston to the top of the wellbore.

5. The method of claim 4, further comprising an upper bumper to engage and stop the free piston's upward progress.

6. The method of claim 4, wherein the wellbore is shut-in to facilitate the piston falling to the lower portion of the wellbore.

7. The method of claim 6, wherein the wellbore is opened after a period of time so that formation gas pressure flow pushes the piston and accumulated formation liquids uphole.

8. The method of claim 4 further comprising sensing the position of the free piston, in the wellbore.

9. A plunger lift system for lifting formation liquids from a well producing through a wellbore communicating with a hydrocarbon formation, comprising:

(a) a free piston with a sleeve including an open end, an opposite end, a hollow passage therebetween to accumulate the formation liquids and a piston face on the opposite end wherein the piston face includes an annular seating surface on the opposite end and a plug that is received therein, (b) the free piston having an external diameter that is substantially similar to the inner diameter of the wellbore;

(c) the free piston being moveable between a top of the wellbore and a lower portion of the wellbore; and (d) the free piston including at least a portion thereof formed of a material that is buoyant relative to the formation liquids and the plug is, at least partially, formed from a material that is more buoyant in formation liquids than the material from which the sleeve is, at least partially, formed.

10. The plunger lift system of claim 9, wherein the plug is independent of the sleeve and moveable through the well apart from the sleeve.

11. The plunger lift system of claim 10, wherein the plug unites with the annular seating surface to form a piston face.

12. The plunger lift system of claim 9, further comprising an upper bumper to engage and stop the piston's upward progress.

13. The plunger lift system of claim 9, further comprising an upper bumper to engage and stop the free piston's upward progress; a decoupler to decouple the plug and sleeve from the united position; a catcher assembly; and a bypass to prevent the piston from being pinned to the top of the wellbore.

14. The plunger lift system of claim 9, further comprising a metal component carried on the free piston.

15. A method of lifting formation liquids from a wellbore using a plunger lift system comprising:

(a) releasing a plug into the wellbore so that it falls from a top of the wellbore to a lower portion of the wellbore;

(b) releasing a free piston into the wellbore so that it falls from the top of the wellbore to the lower portion of the wellbore, the free piston including a sleeve with an open end, an opposite end, a hollow passage therebetween to accumulate formation liquids and a piston face on the opposite end comprising an annular seating surface and being completed when the plug and the annular seating surface of the sleeve are united in the lower portion of the wellbore; the free piston having an external diameter that is substantially similar to the inner diameter of the wellbore; the free piston including at least a portion thereof foamed of a material that is buoyant relative to any formation liquids in the lower portion of the wellbore and the plug being, at least partially, formed from a material that is more buoyant in formation liquids than the material from which the sleeve is, at least partially, formed;

(c) accumulating formation liquids above the free piston; and (d) allowing a residence time to pass so that a formation gas pressure flow pushes the free piston to the top of the wellbore.

16. The method of claim 15, further comprising an upper bumper to engage and stop the free piston's upward progress.

17. The method of claim 15, wherein the wellbore is shut-in to facilitate the piston falling to the lower portion of the wellbore.

18. The method of claim 17, wherein the wellbore is opened after a period of time so that formation gas pressure flow pushes the piston and accumulated formation liquids uphole.

19. The method of claim 18, wherein the plug is independent from the sleeve and the plug is introduced into the wellbore before the sleeve.

20. The method of claim 15, further comprising decoupling the plug from the sleeve after the free piston is pushed to the top of the wellbore.

21. The method of claim 15 further comprising sensing the position of the piston in the wellbore.

* * * * *